US005429077A

United States Patent [19]

Moskal

[11] Patent Number: 5,429,077

[45] Date of Patent: Jul. 4, 1995

[54] WATER HAMMER RAPPER METHOD AND APPARATUS

[75] Inventor: Thomas E. Moskal, Pickerington, Ohio

[73] Assignee: The Babcock & Wilcox Company, New Orleans, La.

[21] Appl. No.: 275,790

[22] Filed: Jul. 15, 1994

[51] Int. Cl.[6] ..... F22B 37/18

[52] U.S. Cl. ..... 122/379; 134/17; 165/84; 165/95

[58] Field of Search ..... 122/379; 165/95, 84; 134/17, 1

[56] References Cited

U.S. PATENT DOCUMENTS 1,840,834 1/1932 Davis, Jr. .
2,775,958 1/1957 Kolling .
3,364,983 1/1968 Krinov et al. .
3,409,470 11/1968 Karpovich ..... 134/1
3,481,784 12/1969 Karpovich ..... 134/1
4,655,846 4/1987 Scharton et al. ..... 134/1
4,750,547 6/1988 Sakamoto .
5,259,446 11/1993 St. Louis ..... 134/1

*Primary Examiner*—Edward G. Favors
*Attorney, Agent, or Firm*—Harness, Dickey & Pierce

[57] ABSTRACT

An apparatus and method by which deposits are removed from the heat exchange surfaces of heat exchange element in a boiler. According to the present invention, a heat exchange medium flowing through the element at a first temperature has injected into it a fluid at a second temperature. The injection of the fluid and the temperature difference between the fluid and the medium causes a pressure wave to be produced in the heat exchange element at a specific location whereby the pressure wave in the medium causes mechanical vibration of the element. The result is that ash, scale, soot and other deposits are fractured, loosened and removed from the surfaces of the element.

20 Claims, 3 Drawing Sheets

WATER HAMMER RAPPER METHOD AND APPARATUS

BACKGROUND OF THE INVENTION

1. Field of the Invention

This invention generally relates to heat exchangers, such as large scale industrial boilers, and particularly relates to a method for removing deposits and encrustations from the heat transfer surfaces of the heat exchanger components.

2. Description of the Related Art

Trash burners and large scale boilers used by public utilities and industry are often fired by ash producing fossil fuels. As a result of these fuels, the internal surfaces of the boiler often become fouled with encrustations of soot, slag and ash during use. To optimize the thermal efficiency of the boiler, it is necessary to periodically remove and clean these deposits from the heat exchanger surfaces.

One type of system presently in wide spread use for deslagging the heat exchanger surfaces is known as a sootblower. Sootblowers are generally mounted exteriorly of the boiler and include a lance tube with a nozzle at one end. The lance is periodically inserted into the boiler through ports located in the boiler wall. While within the boiler, a cleaning medium, such as water, steam, air or another solution, is projected under pressure from the nozzle to impinge against the heat exchanger's surfaces. The mechanical impact and thermal shock caused by impingement of the cleaning medium results in the fracturing and dislodgement of the encrustations from the heat exchange surfaces.

While sootblowers generally operate satisfactorily and are superior devices in many boiler applications, they have certain limitations. First, sootblowers tend to consume a significant amount of the cleaning medium. This is a direct expense which must be recovered by the operator of the heat exchange facility. Additionally, sootblowers are unable to reach areas of the heat exchanger which are inaccessible or beyond the effective discharge range of the cleaning medium. Sootblowers also tend to clean the heat exchange surfaces down to the bare metal. In the highly corrosive and acidic environment found within the boiler, this leaves the cleaned heat exchange surface readily susceptible to corrosion.

Another system for removing encrustations from the heat exchanger surfaces utilizes what are known as rappers. Rappers typically have an impacter which, through a mechanical linkage, produces mechanical vibration in the heat exchange surface. The vibration causes the deposits to disintegrate, fracture and/or dislodge from the heat exchanger surfaces. One advantage of the mechanical rapper has over a sootblower is that the mechanical rapper does not remove the protective oxide layer on the heat exchanger surface. This left behind oxide layer helps to protect the heat exchange surfaces from the corrosive boiler environment. Typically, rappers are manually, pneumatically or electrically actuated.

The most common form of electrically actuated rappers are the falling hammer rapper. In this approach, fixed anvil-shaped weights (hammers) are lifted by a mechanical linkage which is connected to a rotating shaft that is driven by an electric motor. The hammers are allowed to fall and strike an impact transfer pin which imparts mechanical vibration to the heat exchange surfaces and dislodges the encrustations.

Another approach of providing an electrically actuated rapper is to use a solenoid to propel an impacter forward against an impact target. These rappers typically use a spring to retract the impacter after it has been mechanically actuated to impact its associated mechanical linkage during the rapping sequence. Such springs, however, are a drawback since they mechanically wear out relatively quickly and since they introduce vibration into the mechanical impacter itself.

Another approach for providing an electrically actuated rapper uses a dual coil, electromagnetic hammer rapper. The coils are separately energizable to cause forward or retracted movements of a impacter or armature. When the forward coil is energized, the impacter is moved forward to strike an impact transfer pin causing the kinetic energy to be transferred from the impacter and transfer pin to the heat exchange surfaces whereby it induces mechanical vibration and deslags the heat exchange surfaces. When the retraction coil is energized, the impacter is propelled in the rearward direction out of engagement with the impact transfer pin.

Another drawback with the above mechanical and electromechanical rappers is the need for a tie bar affixed to the heat exchangers surfaces and extending up to and through the boiler wall. Tie bars represent the primary difficulties and highest expense associated with any of the above mentioned types of rappers. At the boiler wall, a wall box and sleeve assembly is required to permit passing of the impact transfer pin through the boiler wall to the point where it can be impacted by the rapper device. Additionally, the mechanical tie bar which interconnects the heat exchanger surfaces must be positioned and aligned so that it receives the energy being transmitted through the impact transfer pin. If the boiler was not originally designed to accommodate rappers and the tie bars, the installation of the tie bars requires substantial modification to the boiler. Furthermore, existing tie bar materials and designs limit the use of rapper arrangements to the low temperature regions of the boiler, typically those regions below 1600° F., or where the use of continuous active cooling, such as by recirculating water or air through the tie bar. This need for continual cooling, however, makes the device uneconomical in most applications.

It is therefore a principal object of this invention to provide an apparatus and method by which encrustations and other deposits can be removed from the heat exchange surfaces without requiring the use of sootblowers or mechanical rappers and tie bar assemblies.

It is a further object of this invention to provide an apparatus and method for removing encrustations and deposits from the heat exchange surfaces in a boiler through the inducement of mechanical vibration in the surfaces themselves.

It is another object of the present invention to provide a mechanism for cleaning the heat exchange surfaces by producing controlled pressure pulsations of a given magnitude within the heat transfer elements of at predetermined locations. The boiler thereby induces a vibration in the exterior of the heat exchange surfaces causing dislodgement of the encrustation and deposits thereon.

Still another object of this invention is to provide a mechanism by which steam can be injected into subcooled liquid zones of the boiler thereby inducing a vibration in the heat exchange surfaces causing removal of encrustations and deposits thereon.

It is another object of the present invention to provide an apparatus and method which can be used to clean heat transfer surfaces in the high temperature regions of the boiler, including those regions above 1600° F.

SUMMARY OF THE INVENTION

The above and other objects are provided by a water hammer rapper which creates fluid pressure pulses of a controlled magnitudes on the steam side and at a predetermined location in the heat exchanger. The pulses impart the same type of impact energy as achieved by conventional rapper systems to fracture and remove encrustations and deposits without the need for a network of tie bars or for the need of other structures. The apparatus consists of a water injection circuit designed to release a controlled quantity pulse of sub-cooled water into selected heat exchange elements within a steam boiler. The water pulses or slugs are delivered to specific points in the boiler steam circuit where they create shock waves due to the rapid condensation and boiling at the steam/water interface. The sudden onset of condensation in the super heated steam, of the heat exchange element along with the rapid boiling of the injected slug of water, results in an explosion or implosion that creates shock waves within the steam circuit and, the heat exchanger tubes.

This phenomenon is similar that referred to as water hammer. By controlling the quantity of injected water and the rate of injection, it is possible to control the heat-up of the water during its delivery to the desired location for occurrence of water hammer. Thus, the magnitude and location of the water hammer can be controlled. For maximum effect, it is believed that water hammer should be induced to occur at the antinodes of resident vibration or region of maximum deflection for the heat exchanger element.

In an alternative embodiment, steam is injected or delivered to specific points in the boiler's subcooled water circulation circuit. The steam slug creates a pressure pulsation as it collapses in upon itself resulting in mechanical vibration being introduced into the components of the boiler.

One advantage of the present invention is that it has the advantage of eliminating moving parts while creating the impact forces necessary for inducing vibration in the heat exchange element. Instead, this is achieved through the control of a thermodynamic phenomenon. The present invention is relatively inexpensive to install since one water/steam slug injector could be made to service many locations within the fluid circuit of the boiler. As a result, significant cost and technical advantages are achieved over mechanical and electromechanical rapping devices. This includes eliminating the mechanical rappers themselves as well as eliminating the tie bars needed to transmit the kinetic energy to the heat exchange elements or boiler tube bank. By eliminating the tie bars, the water hammer rapper of the present invention makes available a technique which is viable in installations where corrosion of the tie bar would otherwise eliminate mechanical rapping from consideration or where the tie bar itself would present an undesirable collection point for additional deposit accumulation.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE PREFERRED EMBODIMENTS

Figure 1:
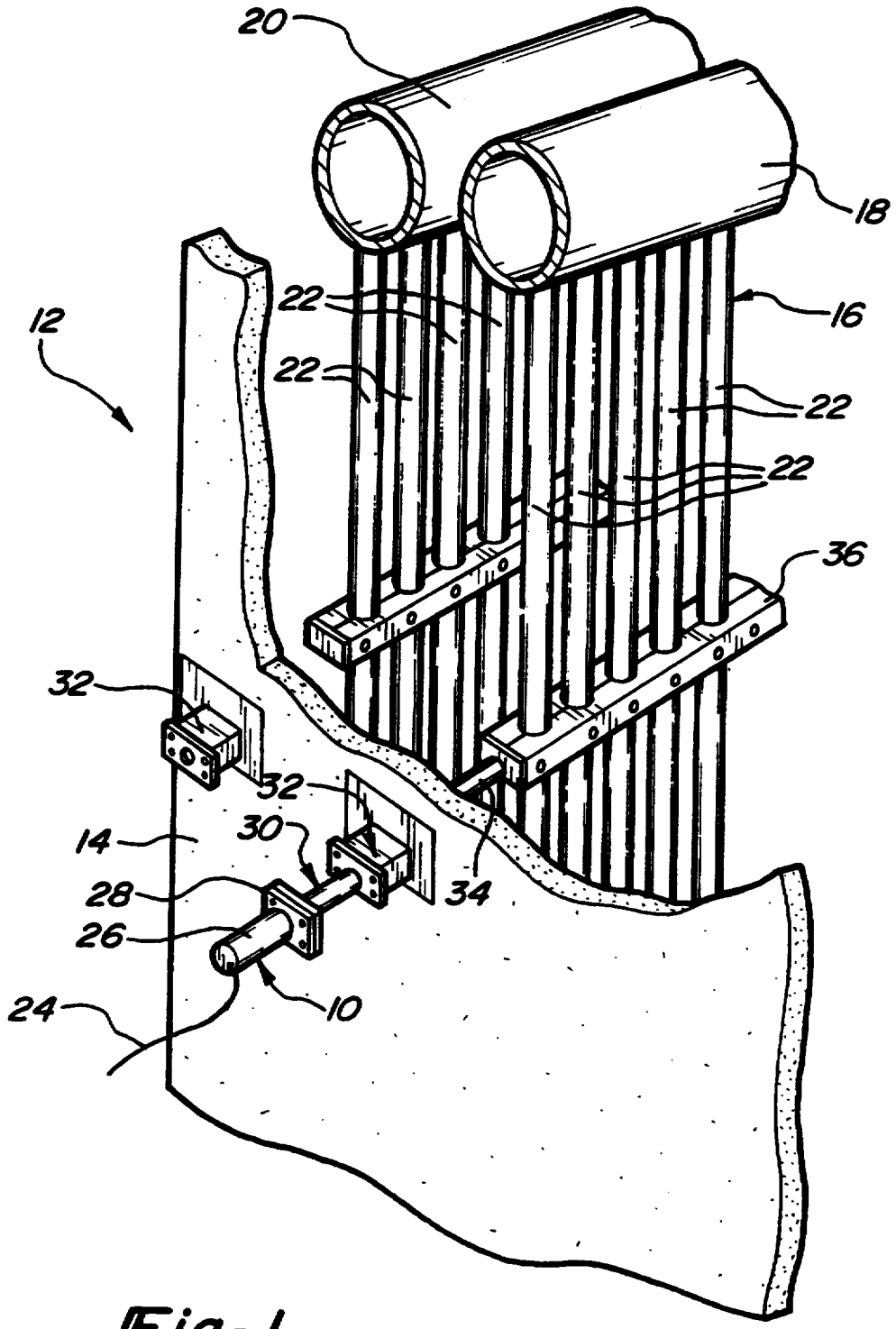
Fig-1 PRIOR ART
FIG. 1 is a partial perspective view of a rapper and tie bar system in accordance with the one variety of the prior art and showing how the rapper is coupled through the tie bar to the heat exchange elements.

Referring now to the drawings, a hammer rapper assembly 10 in accordance with the prior art is shown mounted to the various components of a large scale industrial boiler which is generally designed at 12. The boiler 12 is generally represented by the boiler wall 14 and the bank of tubes or heat exchange elements designated at 16. The elements 16 are part of a steam piping circuit that further includes a pair of headers 18.

The illustrated heat exchange elements 16 are dependent boiler tubes 22 which typically extend downward in a U-shaped configuration from the headers 18, approximately fifteen to thirty feet therebelow. While water is circulated through the boiler tubes 22 from the headers 18 to extract heat from the gas side thereof, it is also common for super heated steam to be used as the heat transfer medium. As a result of the hot combustion gases contacting the cooler boiler tubes 22, the exterior surfaces of the boiler tubes 22 become susceptible to the accumulation of soot, scale and ash. To maintain maximum efficiency, these surfaces require periodic cleaning.

The prior art hammer rapper 10 illustrated in FIG. 1, is an electromechanical device in which a hammer rapper 26 is connected by a electrical cable 24 to a controller (not shown) which communicates electrical signals for actuation of the hammer rapper 26. A mounting flange 28 of the hammer rapper 26 is connected to the outboard end of an impact transfer pin assembly 30. The impact transfer pin assembly 30 is in turn mounted in a wall box and sleeve assembly 32 which is fitted in an access port defined in the boiler wall 14. The wall box and sleeve assembly 32 cooperate as a guide to direct an impact transfer pin 34 of the impact transfer pin assembly 30 into abutting contact with a tie bar 36. The tie bar 36 is mounted to interconnect a plurality of the boiler tubes 22, maintaining them in an evenly spaced arrangement, and transfers kinetic energy from the hammer rapper 26 through the impact transfer pin 34 to the boiler tubes 22.

While FIG. 1 only illustrates a single electromechanical hammer rapper 26 for deslagging a particular section of boiler tubes 22, it should be appreciated that a single hammer rapper 26 can be simultaneously coupled to a number of impact transfer pin assemblies for transmitting the kinetic energy to multiple boiler tubes 22. It should also be understood that individual hammer rappers 26 can be used in connection with individual impact transfer pin assemblies 30 at each row of boiler tubes 22. Additionally, other manually, mechanically and electromechanically actuated hammer rappers of other varieties, including those commonly known as falling hammer rappers, could be used.

Figure 2:
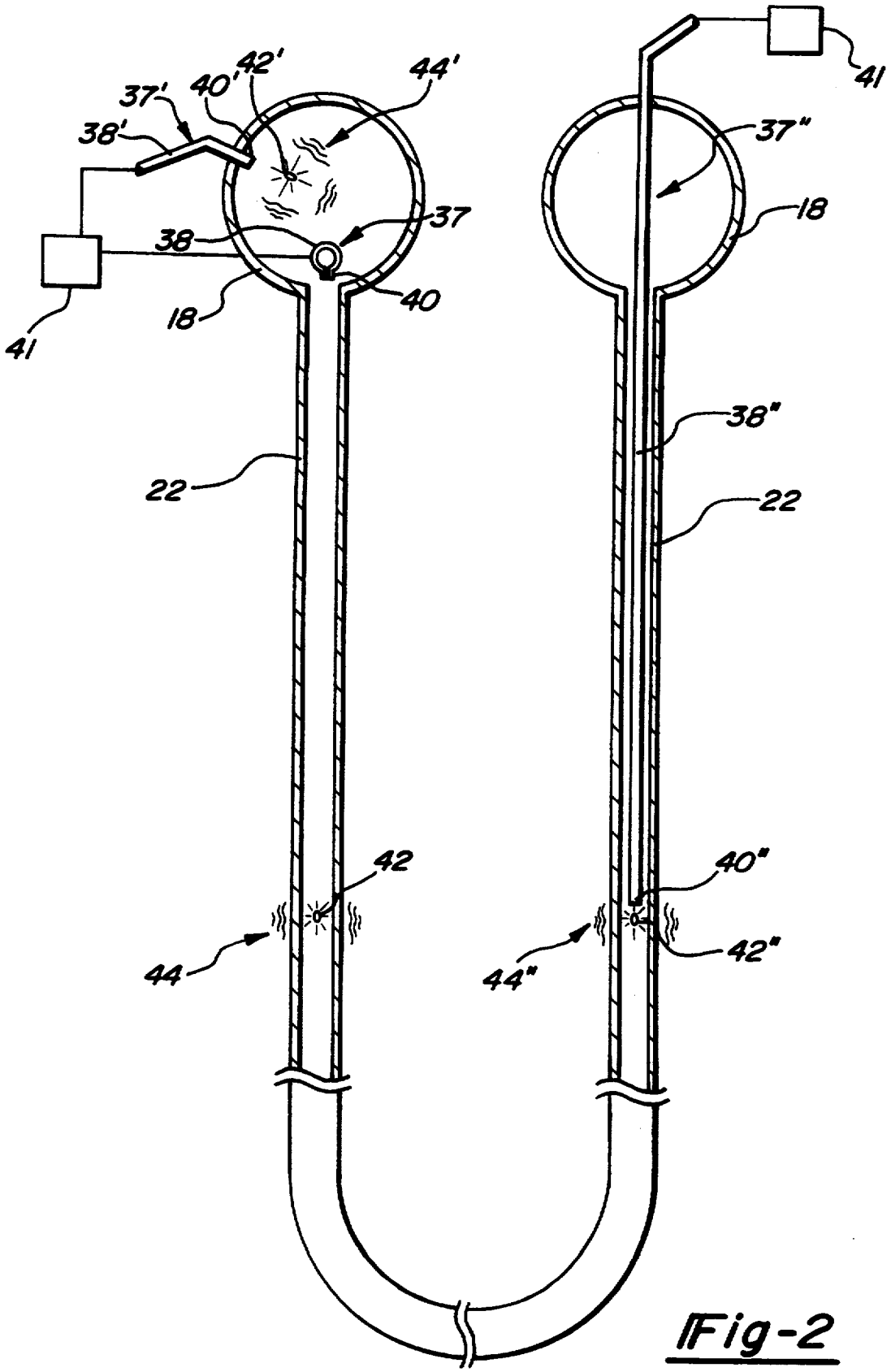
FIG. 2 is a schematic illustration of a pair of heat exchange elements as might be found in a boiler and illustrates three embodiments of a water hammer rapper incorporating the principles of the present invention.

Referring now to FIG. 2, it will be seen that a pair of headers 18, as might be found in the super heater region of a boiler 12, are schematically illustrated in cross-section along with a dependent boiler tube 22. While only shown with a single dependent boiler tube 22, it should be understood that multiple boiler tubes 22 may extend from the respective headers 18 in side-by-side relation to one another, as in a typical construction. Additionally, the two illustrated headers 18 need not be interpreted as being connected to one another through their respective boiler tubes 22. Rather, the headers 18 and their boiler tubes 22 are merely being shown to illustrate three embodiments of the present invention. Two embodiments being illustrated in the left-hand portion of FIG. 2 and the other embodiment being illustrated on the right-hand portion of the figure.

In a typical boiler 12 installation, either steam or water is circulated from the header 18 through the boiler tubes 22. The boiler tubes 22 are positioned so that hot, combustion gases from the combustion chamber (not shown) of the boiler 12 pass over their surfaces and transfer heat to the steam or water circulating therein. Resulting from the hot combustion gasses passing over the cooler boiler tubes 22, ash, soot, scale and other encrustations become deposited on the exterior surfaces of the boiler tubes 22. As these encrustations build up, the thermal efficiency of the boiler tubes 22 dramatically decreases thereby increasing the costs associated with operating the boiler 12. It is therefore necessary to remove the encrustations from the heat exchanger or exterior surfaces of these tubes 22. The present invention proposes removing the encrustations by imparting vibrations into the boiler tubes 22. This is achieved in the present invention by exploiting a phenomenon commonly referred to herein as condensation-induced shock or, in the extreme instance, water hammer.

Condensation-induced shock is generally the rapid injection of cold water, in the form of a water slug or individual water droplets, into a superheated steam environment. Upon injection, the cold water will immediately cause condensation of the surrounding steam resulting in a rapid and dramatic reduction in pressure. This continues until the water injection is halted. After the injection of the water is complete, the remaining condensate in the boiler tube will vaporize as it absorbs heat from the surrounding steam and the hot boiler tubing. The dynamic pressure fluctuations which result from the water injection propagate through the steam to the boiler tube or superheater wall. When created in a localized manner, as by the injection of droplets or a small slug of water, the pressure pulsations will be transmitted to the wall as shock waves created by the sudden implosion of steam in the immediate vicinity of the water droplets or slug.

Water hammer is a relatively well known phenomenon that may occur in a closed conduit when there is either a retardation or acceleration of fluid flow, such as that which occurs during the opening or closing of a valve in the conduit. In a water-filled boiler tube, the water hammer phenomenon can be created by generating slugs or pockets of steam within the conduit which are then rapidly accelerated by the collapse of the steam bubbles or pockets due to condensation. When this occurs, the collapsing fluid vapor cavity produces a high pressure wave within the fluid flow which transmits vibration to the heat exchange surfaces of the boiler tubes.

The present invention uses either the condensation-induced shock or the water hammer phenomenon to produce mechanical vibration of a controlled magnitude on the interior or steam/water side of the boiler tubes 22 which then imparts this energy to the boiler tubes 22 causing them to violently vibrate. This vibration fractures the encrustations and deposits causing them to be removed. A network of tie bars extending throughout the gas side of the boiler enclosure is therefore not required. For maximum effect, the present invention controls the production of water hammer so that it will occur in the anti-nodes of resonant vibration or the areas of maximum deflection for each of the boiler tubes 22.

Referring now to the left portion of FIG. 2, a header 18 and boiler tube 22 in a steam boiler 12 is illustrated therein. Located within the header 18 are two embodiments of the present invention.

In the first embodiment, the water hammer rapper 37 includes a conduit 38 which extends axially within the header 18. The conduit includes at least one nozzle 40 which is oriented so that its outlet is directed centrally down one of the boiler tubes 22. The conduit 38 is connected to a water supply and a controller 41 which delivers sub-cooled water through the conduit 38 and nozzle 40. The controller causes a controlled quantity of water, herein referred to as a water slug 42, to be delivered as a pulsed injection from the nozzle 40 down into the boiler tube 22. Depending on the steam conditions existing within the boiler tube 22, the rate of delivery of the water slug 42, as well as the quantity of water in the water slug 42, is controlled. The water slug 42 is controlled in this fashion so that, at the anti-node of the boiler tube 22 (the location of maximum deflection), the steam carried in the boiler tube 22 will be subjected to the sudden onset of condensation resulting in an implosion/explosion of the water slug 42 at the steam/water interface creating the condensation-induced shock phenomenon in a controlled manner. The resulting fluid pressure wave 44 induces mechanical vibration in the boiler tube 22 with an impact energy that is sufficient to fracture and remove deposits from the exterior heat transfer surfaces. Thus, scale and any other accumulated deposits can be removed from the boiler tubes 22 without requiring the use of tie bars.

Using this technique, the conduit 38 can be advanced or retracted so that the nozzle 40 will be directed down either all or specific boiler tubes 22 to achieve a maximum cleaning effect. In another embodiment, the conduit 38 can be stationary and provided with a multiple number of nozzles 40, each directed down an individual boiler tube 22. If desired, the nozzle 40 can further be provided with a pressure sensitive or otherwise actuated valve mechanism or means that will permit the ejection of the water slug 42 at an appropriate rate and with the appropriate quantity of water to induce water hammer at the desired location in the boiler tube 22.

A second embodiment of the water hammer rapper is also seen in the header 18 on the left side of FIG. 2 and is generally designated at 37'. In this embodiment, the water hammer rapper 37' is positioned so that a nozzle 40' will discharge a water slug 42' in the header 18 itself. The ensuing pressure pulse 44' and its resulting vibration is then transferred both hydraulically and mechanically to the boiler tubes 22 where the deposits and encrustations are fractured and removed. As with the previous embodiment, the hammer rapper 37' is coupled through a conduit 38' to a water supply and controller (not shown) which deliver sub-cooled water through the conduit 38' to the nozzle 40'. The controller again causes a controlled quantity water slug 42' to be delivered as a pulsed injection that induces the pressure pulse 44' in the header 18 itself.

Referring now to the header 18 and boiler tube 22 illustrated on the right side of FIG. 2, a second embodiment of a water hammer rapper 37" embodying to the principles of the present invention is illustrated therein. As mentioned above, water flows through this header 18 and boiler tube 22.

In this embodiment, a delivery conduit 38", coupled to a source of pressurized steam (not shown), extends from the source through the header 18 and downward into a boiler tube 22. The conduit 38" terminates in a nozzle 40" at the anti-node of resonant vibration in the boiler tube 22.

When the heat exchange surface of the boiler tube 22 is in need of cleaning because the encrustations have developed thereon, a pulse of steam, generally designated at 42", is ejected from the nozzle 40" creating a steam bubble within the water circulating through the boiler tube 22. Due to the sudden onset of rapid condensation at the steam/water interface, the steam bubble 42" collapses, creating water hammer as the water rushes to fill the evacuated space of the bubble 42". The resulting pressure wave caused by water hammer induces mechanical vibration in the boiler tube 22 which in turn fractures and removes deposits without necessitating a network of tie bars extending throughout the combustion gas side of the boiler 12.

While only one conduit 38" is illustrated as extending in one boiler tube 22, it will be apparent that a single delivery conduit 38" could be provided for each boiler tube 22 or provided for a group of boiler tubes 22 or provided for successive insertion and retraction throughout a series of boiler tubes 22 so as to perform the necessary cleaning function.

Figure 3:
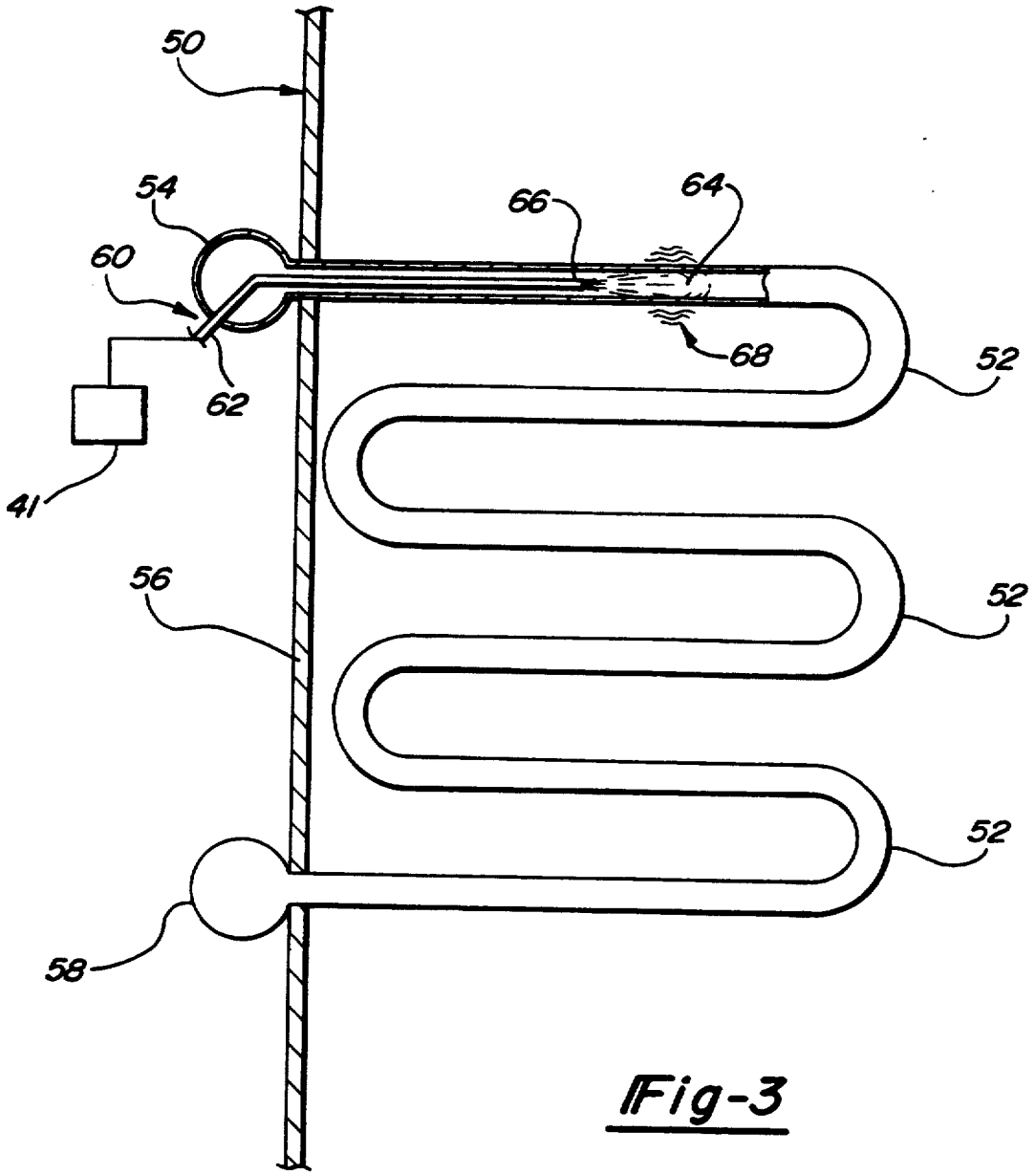
FIG. 3 is a schematic illustration of a different boiler geometry in which another embodiment of the present invention might be employed.

Another embodiment of the present invention is illustrated in FIG. 3 and generally shows the geometry of the boiler tubes (economizers) 52 as might be found in a boiler 50 using circulated water as the heat transfer medium. The boiler tubes 52 extend from an upper header 54 through the boiler wall 56 to the interior of the boiler where they serpentine downward until exiting through the boiler wall 56 and into a lower header 58. As suggested above, water is circulated from the upper header 54 through the boiler tuber 52 to the lower header 58.

A water hammer rapper 60 according to this third embodiment includes a conduit 62 connected to a source of superheated steam (not shown). A controller (not shown) causes a pulse of the steam (steam pulse 64) to be emitted from a nozzle 66 on the end of the conduit 62 at a predetermined location in the boiler tube 52. The vapor cavity of the steam pulse 64 immediately begins to cool and condense. The rapid acceleration of the collapsing steam pulse 64 produces a high pressure wave 68 within the fluid flow which transmits vibration to the heat exchange surfaces of the boiler tubes 52. The quantity and rate of introduction of the steam pulse 64 is controlled by the controller so that the magnitude of the resulting pressure wave 68 is sufficient to cause fracturing and dislodgement of the accumulations on the exterior of the boiler tube 52 and leaving a clean boiler tube 52.

While the above description constitutes the preferred embodiments of the present invention, it will be appreciated that the invention is susceptible to modification, variation and change without departing from the proper scope and fair meaning of the accompanying claims.

I claim:

1. A method for cleaning deposits and other encrustations from heat exchange surfaces of a heat exchange element having a heat exchange medium flowing therethrough, said method comprising the steps of:

injecting a fluid into said heat exchange medium within said heat exchange element, said fluid being injected at a temperature different from the temperature of said heat exchange medium;

inducing a pressure wave in said heat exchange medium and within said heat exchange element, said pressure wave causing vibration of said heat exchange element and said heat exchange surfaces;

controlling the location within said heat exchange element at which said pressure wave is induced thereby producing a localized vibration in said heat exchange element; and dislodging deposits and other encrustations from said heat exchange surfaces of said heat exchange element as a result of the production of said pressure wave in said heat exchange medium, said deposits and other encrustations being dislodged in an area extending beyond the area of said localized vibration.

2. The method for cleaning deposits and other encrustations from heat exchange surfaces as set forth in claim 1 wherein said fluid is injected into said heat exchange medium at a temperature which is greater than the temperature of said heat exchange medium thereby creating said pressure wave within said heat exchange element.

3. The method of cleaning deposits and other encrustations from heat exchange surfaces as set forth in claim 1 wherein said fluid is injected into said heat exchange medium at a temperature which is less than the temperature of said heat exchange medium thereby creating said pressure pulse within said heat exchange element.

4. The method for cleaning deposits and other encrustations from heat exchange surfaces as set forth in claim 1 wherein said fluid is injected into said heat exchange medium at a predetermined location thereby producing said localized vibration in said heat exchange element generally at said predetermined location.

5. The method for cleaning deposits and other encrustations from heat exchange surfaces as set forth in claim 1 wherein said fluid is injected into said heat exchange medium at a location spaced apart from the location at which said pressure wave is caused to occur within said heat exchange element.

6. The method for cleaning deposits and other encrustations from heat exchange surfaces as set forth in claim I wherein said fluid is in one phase and said heat exchange medium is in another phase.

7. The method for cleaning deposits and other encrustations from heat exchange surfaces as set forth in claim 6 wherein said heat exchange medium is water and said fluid is steam.

8. The method for cleaning deposits and other encrustations from heat exchange surfaces as set forth in claim 6 wherein said heat exchange medium is steam and said fluid is water.

9. The method for cleaning deposits and other encrustations from heat exchange surfaces as set forth in claim 1 wherein said pressure wave is caused to occur at an antinode of resonant vibration of said heat exchange element.

10. The method for cleaning deposits and other encrustations from heat exchange surfaces as set forth in claim 1 wherein said pressure wave is created by water hammer.

11. The method for cleaning deposits and other encrustations from heat exchange surfaces as set forth in claim 1 wherein said pressure wave is created by condensation-induced shock.

12. An apparatus for cleaning deposits and other encrustations from heat exchange surfaces of a heat exchange element having a heat exchange medium flowing therethrough at a first temperature, said apparatus comprising:

supply means for supplying a fluid at a second temperature;

a conduit coupled to said supply means and delivering said fluid to the heat exchange element;

a nozzle on said conduit, said nozzle adapted to eject said fluid from said conduit and inject said fluid into the heat exchange medium; and control means for controlling injection of said fluid into the heat exchange medium such that a pressure wave is caused to occur at a predetermined location within the heat exchange element as a result of the difference in temperature between said fluid and the heat exchange medium, said pressure wave inducing vibration in the heat exchange medium in the area of said predetermined location, said pressure wave in the heat exchange medium generally inducing mechanical vibration in said heat exchange element at said predetermined location thereby fracturing and dislodging deposits and other encrustations from the heat exchange surfaces of the heat exchange element.

13. An apparatus for cleaning deposits and other encrustations from heat exchange surfaces as set forth in claim 12 wherein said conduit extends into the heat exchanger element.

14. An apparatus for cleaning deposits and other encrustations from heat exchange surfaces as set forth in claim 13 wherein said nozzle is positioned at said predetermined location.

15. An apparatus for cleaning deposits and other encrustations from heat exchange surfaces as set forth in claim 12 wherein said nozzle is generally located in a remote position from said predetermined location.

16. An apparatus for cleaning deposits and other encrustations from heat exchange surfaces as set forth in claim 15 wherein said fluid is injected into the heat exchange medium at a location remote from said predetermined location and induces said pressure wave at said predetermined location.

17. An apparatus for cleaning deposits and other encrustations from heat exchange surfaces as set forth in claim 16 wherein said fluid is injected so as to control the magnitude of said pressure wave at said predetermined location.

18. A boiler having a combustion gas chamber through which combustion gases are circulated, said boiler comprising:

at least one heat exchange element including a header and at least one boiler tube, said boiler tube being located within said chamber and exposed to gases therein, said heat exchange element generally being in the form of a conduit having exterior heat exchange surfaces exposed to the combustion gases in said boiler and on which combustion bi-products accumulate as deposits or other encrustations;

a heat exchange medium at a first temperature, said heat exchange medium flowing through said element and being heated by the combustion gases;

supply means for supplying a discharge fluid at a second temperature;

a conduit adapted to receive said discharge fluid from said supply means and to deliver said discharge fluid; and a nozzle on said conduit, said nozzle adapted to discharge said discharge fluid from said conduit and inject said discharge fluid into said heat exchange medium within said heat exchange element, said discharge fluid being injected into said heat exchange medium in an amount and at a rate sufficient to cause development of a pressure wave in said heat exchange medium and said heat exchange element at a predetermined location, said pressure wave inducing mechanical vibration in said heat exchange element, said mechanical vibration being of a magnitude sufficient to fracture and dislodge deposits and other encrustations from said heat exchange surfaces in an area extending beyond said predetermined location of said heat exchange element.

19. A boiler as set forth in claim 18 wherein said conduit extends into said boiler tube with said nozzle being located at said predetermined location within said boiler tube.

20. A boiler as set forth in claim 18 wherein said conduit extends within said header and said nozzle is directed into said boiler tube, said conduit and nozzle being adapted to inject an amount of said fluid into said element such that said amount travels into said boiler tube a distance corresponding to said predetermined location before creating said pressure wave therein.

* * * * *